United States Patent [19]

Ellzey

[11] 4,332,411

[45] Jun. 1, 1982

[54] OIL WELL PIPE PICKUP AND LAYDOWN APPARATUS

[75] Inventor: Rex B. Ellzey, Laurel, Miss.

[73] Assignee: Benton Casing Service, Inc., Houma, La.

[21] Appl. No.: 53,832

[22] Filed: Jul. 2, 1979

[51] Int. Cl.[3] ..... B66C 1/44

[52] U.S. Cl. ..... 294/104; 414/745

[58] Field of Search ..... 294/82 R, 83 R, 67 AB, 294/104, 92, 97; 414/22, 745, 747

[56] References Cited

U.S. PATENT DOCUMENTS

| | | | |
|---|---|---|---|
| 3,041,101 | 6/1962 | Lebre | 294/104 X |
| 3,672,717 | 6/1972 | Sayre | 294/104 |
| 4,099,630 | 7/1978 | Beck | 414/745 X |

*Primary Examiner*—Stanley H. Tollberg

*Attorney, Agent, or Firm*—Berman, Aisenberg & Platt

[57] ABSTRACT

A system for picking up and laying down oil well tubular products (essentially casing, tubing, and drill pipe), including a conventional pickup and laydown machine having an endless conveyor in the form of a cable loop with upper and lower parallel courses, and a pair of clamping tools for attachment to opposite ends of a joint of pipe to be moved up to a drill floor or down from a drill floor by the use of the conveyor cable. Each tool comprises a rigid pipe supporting member, a pad secured to the member by a first pivot to turn and clampingly engage or disengage a pipe, and a connecting member attached to the conveyor and secured to the rigid member by a second pivot, the tool parts being so shaped and arranged that the weight of a pipe causes the pad automatically to turn and lockingly clamp the pipe, and lifting the pipe slightly to remove its weight from the tool causes the pad automatically to turn and release its clamping engagement. Preferably, one tool is designed to engage and clamp the outer surface of the pipe while the other tool is designed to engage and clamp the inside pipe surface.

19 Claims, 12 Drawing Figures

OIL WELL PIPE PICKUP AND LAYDOWN APPARATUS

FIELD OF THE INVENTION

This invention relates generally to the oil well drilling industry, and more particularly, to an improved system and apparatus for picking up and laying down tubular oil well vessels.

DESCRIPTION OF THE PRIOR ART

At times when the annular hole of an oil well needs stabilization, it is necessary to remove the drill pipe from the well that has been drilled to allow the insertion of surface, intermediate, or production casing. When the drill pipe is removed from the well it is done one joint at a time, and since often several thousands of feet are involved and because the drill pipe joints or sections are an average length of thirty feet and extremely heavy, it is necessary to make this removal process as expedient as possible. It is highly nonfeasible for this job to be done manually, even by several men. The removal of pipe from the well is known as "laying down" drill pipe.

After drill pipe has been laid down, casing is then "picked up" or lifted from the ground one joint (or section) at a time and carried to the drill floor where it is inserted into the well or hole that has been drilled. This must be done as quickly as is safely possible because the annular walls of the well will only remain stable for a short span of time before collapsing. Since each joint of casing averages forty feet in length and can weigh up to four thousand pounds, the accidental dropping of even one joint that strikes a worker would most likely be serious and possibly fatal.

In "picking up" and "laying down" pipe, it is common to utilize what is called a "pickup and laydown machine" which is diagrammatically illustrated in FIG. 1, and further described hereinafter. The machine uses a pair of tools on a conveyor cable to grasp first one end of a joint of pipe, move it horizontally and downwardly, while the other end is lowered to be grasped by the second tool. The movement is continued to carry the pipe horizontally and downwardly away from the drill floor to be deposited on a rack until all the pipe has been laid down. This operation is reversed to insert casing and then restore the pipe, a section at a time, to vertical position above the well opening for reinsertion into the well and subsequent further drilling or production services. Usually, the pair of tools associated with the machine conveyor involve merely an open top and open ended cradle in which the pipe is laid, and a similar cradle having one end closed for holding the other end of the pipe. Since the pipe is dropped and simply lays in these cradle tools, it frequently misses or bounces out, causing serious injury to workers in the vicinity and breakage of other apparatus as well as damage to the pipe itself. During the time the upper end of the pipe is being lowered by the rotary driller, great skill and synchronism are necessary on the part of the pickup machine operator, who is moving the lower end of the pipe downward away from the derrick floor to prevent the pipe's lower end from sliding out of its cradling tool.

It is known to substitute tools for the cradles described, which are manually locked, tied or clamped to the pipe to lessen the danger of the pipe falling. The alternate tools include split pipe cradles, cable slings, and manually locked clamps. These alternate tools are slow and inefficient to use, and have not prevented, with certainty, dropping of the pipe. Aside from the resultant personal injuries and loss of life, the conventional apparatus has proved extremely costly in loss of time, and cost of repair or replacement of broken apparatus and pipe.

SUMMARY OF THE INVENTION

It is the primary object of the present invention to provide improved apparatus for picking up and laying down oil well tubular vessels which will overcome all of the defects and disadvantages of conventional apparatus as briefly outlined above.

It is another important object of the invention to provide improved tools for use with a pickup and laydown machine which will automatically lock onto a pipe and actuated by the weight of the pipe, and automatically release the pipe when the force of the pipe weight is removed from the tool.

It is a further important object of the invention to provide improved oil well tubular products handling tools and apparatus, having the above described characteristics which greatly improve the safety of picking up and laying down pipe with consequent saving of lives and reduction of injuries.

Yet another object of the invention is to provide improved tools and apparatus, having the above described characteristics, which by reducing the number of accidents save time and reduce the cost of the pickup and lay down operations, and save time and the cost of breakage, repair and replacement of broken pipe and apparatus, as well as reduce costs by enabling use of less skilled operators of the pickup and lay down machine.

Still another object of the invention is to provide improved pipe handling tools having the above described characteristics, which are simple to fabricate and use, inexpensive to make, durable so as to require little maintenance, and which save costs by speeding up the pickup and lay down operations and lessening the required labor.

The above objects are achieved by provision of two improved clamping tools having automatic locking and unlocking features. One tool embodies a J-shaped rigid pipe support member having a triangular plate pivoted at one corner to its stem. A clamping pad is pivoted to a second corner of the plate, and a tool connector to the pickup machine is pivoted to the third corner of the plate. A trigger arm fulcrumed to the curved base of the J-shaped member has a trigger located in said curved base and is pivoted to the triangular plate between the first and third corners. When a pipe seated in the curved base of the J-shaped member, its weight moves the trigger arm to turn the plate and pad into clamping position over the top of the pipe. When the pipe is lifted slightly, springs return the pad, plate and trigger to their unclamped positions.

The second improved tool embodies a long arm having a hook portion at its bottom end and a finger affixed across the end of the hook portion. A pair of pads are pivoted to the ends of the finger and spring biased toward each other at their outer ends. A tool connector to the pickup machine is pivoted to the upper end of the arm. When the tool is inserted in the end of a pipe, the weight of the pipe turns the finger and the pads to exert clamping pressure against the internal surface of the pipe. When the pipe is lifted slightly with respect to the tool, the finger and pads turn to release the clamping pressure.

BRIEF DESCRIPTION OF THE DRAWINGS

The novel features that are considered characteristic of the invention are set forth with particularity in the appended claims. The invention itself, however, both as to its organization and method of operation, together with additional objects and advantages thereof, will best be understood from the following description of specific embodiments, when read in connection with the accompanying drawings, wherein like reference characters indicate like parts throughout the several figures, and in which:

DESCRIPTION OF THE PRIOR ART APPARATUS

Figure 1:
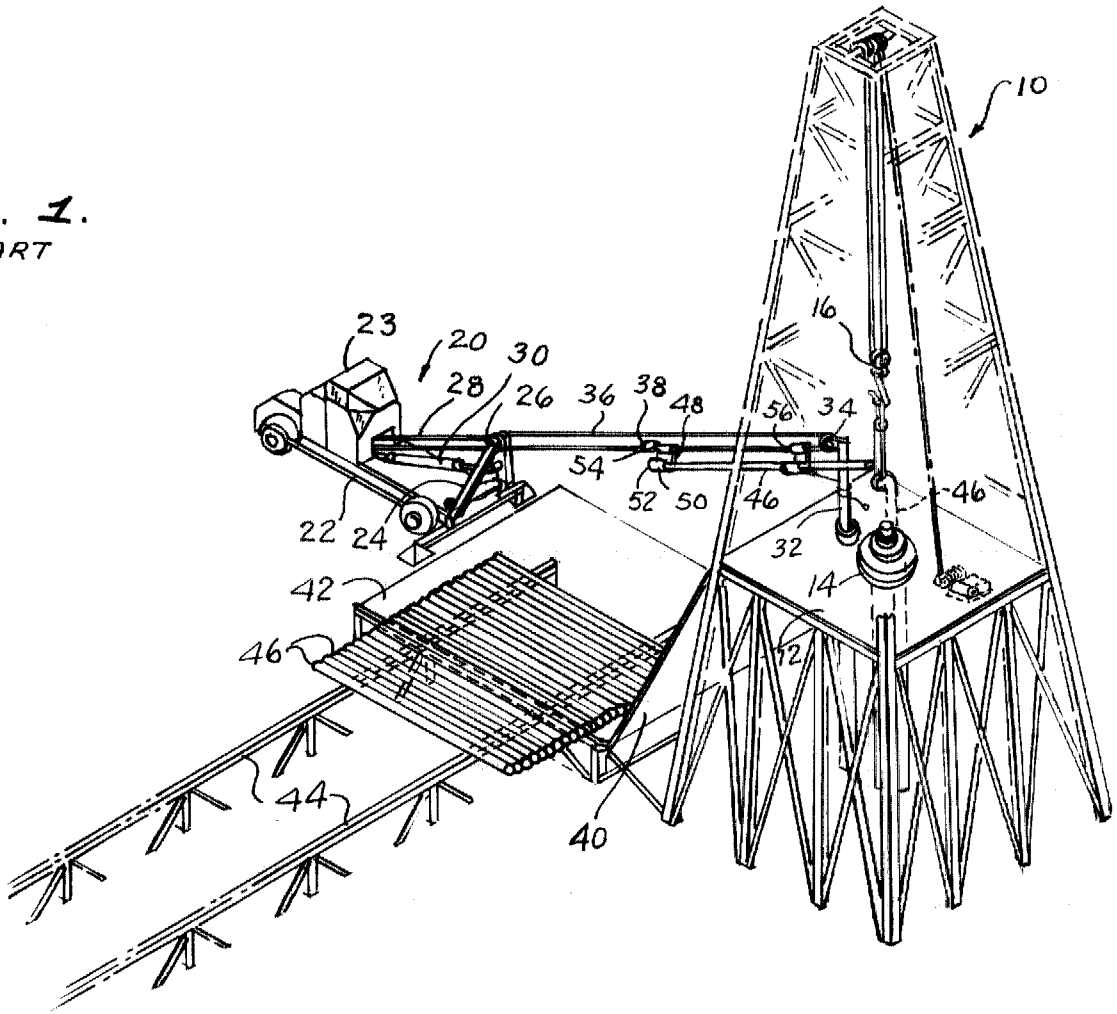
FIG. 1. PRIOR ART
FIG. 1 is a diagrammatic perspective view of conventional apparatus for picking up and laying down oil well drill pipe.

Referring now more particularly to the drawings, FIG. 1 illustrates diagrammatically a conventional pickup and lay down machine operating in conjunction with an oil well derrick to lay down and pick up pipes. A brief explanation of the conventional apparatus will serve to yield a better understanding of the improvements and advantages gained by the present invention.

The oil well derrick, generally referenced 10, includes a platform or floor 12, a well head or rotary table 14, hoist tackle 16 along with other apparatus, not shown.

The pickup and lay down machine, generally referenced 20, includes a wheeled vehicle 22, an operator's cab 23, a pivoted triangular support 24 for pulley 26, hydraulic cylinder 28 for moving the support 24 and cable 30 for turning pulley 26. A fixed standard 32 extends upwardly through an opening in the derrick floor 12 and supports a companion pulley 34 over which is trained an endless conveyor 36 in the form of a strong cable looped also over pulley 26 to define upper and lower parallel reaches, or courses, aligned with the well head 14. An abutment member, or stop 38, is affixed to the lower course of the conveyor 36.

The derrick platform is angled downwardly at 40 and extended horizontally from the bottom of this ramp into a cat walk at 42. A pair of rails 44 forms a storage rack for picked up pipe sections 46. The rack is supported partly on platform portion 42 and partly on legs extending from the ground adjacent the platform. The rack is generally horizontal, but a portion on the platform may be slightly inclined downwardly for rolling the pipe sections by gravity away from conveyor 36.

Two conventional tools for holding and moving the individual pipe sections 46 are shown slideably mounted on the lower course of conveyor 36. The "bucket" 48 comprises a semicylindrical tube 50 closed at one end by an upstanding circular plate 52. The tube 50 is attached to the bottom of an arm 54 whose upper end is slidingly looped about the cable 36. The "cradle" 56 is substantially the same as "bucket" 48, but does not have the circular end plate 52.

The above described conventional equipment is operated as follows to lay down pipe. With both tools 48,56 slid to the right end of the conveyor 36 by movement of stop 38, the pickup machine is ready to receive a pipe section 46 which has been elevated to the broken line position, FIG. 1, by the derrick hoist operator, and uncoupled from the remainder of the pipe still in the well by workers on platform 12. A worker then wraps a length of rope about the pipe section hanging from tackle 16, and swings the bottom of the pipe into "bucket" 48 against end plate 52. The hoist operator then lowers tackle 16 while the pickup machine operator moves the lower course of the conveyor to the left in the direction of arrow A at speeds synchronized to hold the pipe end in bucket 48, while the pipe upper end lowers more and more until it approaches the conveyor. At this time, one or more workers unhook the top end of the pipe section from tackle 16 and with a rope sling, swing the top end to drop into "cradle" 56. The weight of the pipe in tools 48,56 causes them to continue to move with the moving conveyor until the pipe section comes opposite the rack rails 44. At this same time, a worker uses a rope sling to swing the pipe toward and over the rails and the pickup machine operator activates hydraulic cylinder 28 to move the pulley support 24 from its position shown in FIG. 2 to that shown in FIG. 3. This relaxes the conveyor 36 to drop the pipe section on the rack rails 44 so as to lift the pipe out of the tools 48,56. The released pipe is free to be rolled on the rails to a storage position until required for pick up, or reinsertion into the well. The steps for pick up are performed in reverse order and reverse directions of pipe movement.

It should be recognized from the above, that the conventional method and apparatus described for picking up and laying down pipe are highly susceptible to dangerous accidents because the "bucket" and "cradle" tools merely receive and seat the long, heavy pipes and if the pipes are not carefully swung into the tools, they can and do easily bounce out to fall upon the workers on the derrick platform. Careful and skilled synchronized movements of the conveyor and derrick hoist are also needed to prevent the pipe from falling out of the tools and maiming or killing adjacent workmen.

DESCRIPTION OF THE PREFERRED EMBODIMENTS

Figure 2:
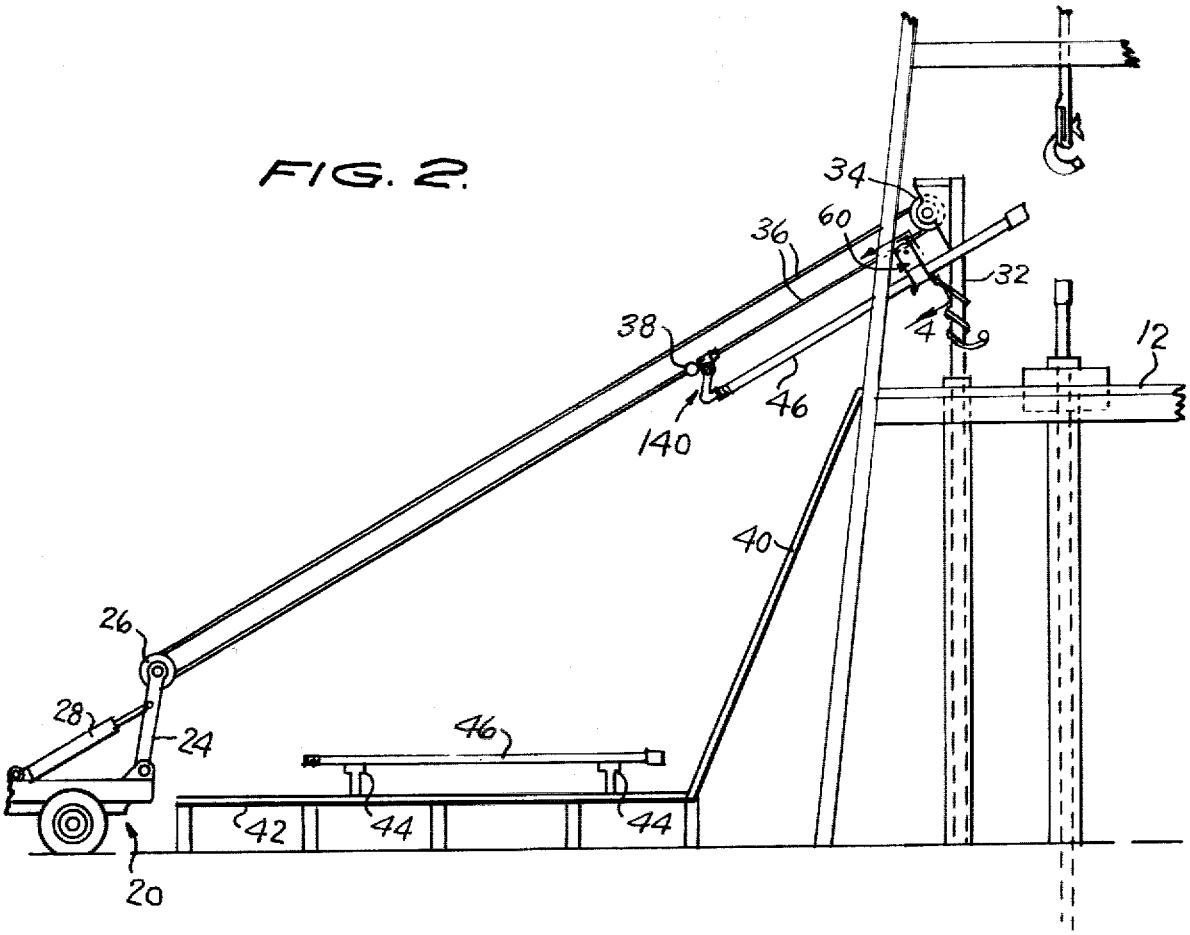
FIG. 2 is a fragmentary side view of the pickup machine of FIG. 1 showing a pair of pipe clamping tools according to the invention in use thereon.
Figure 3:
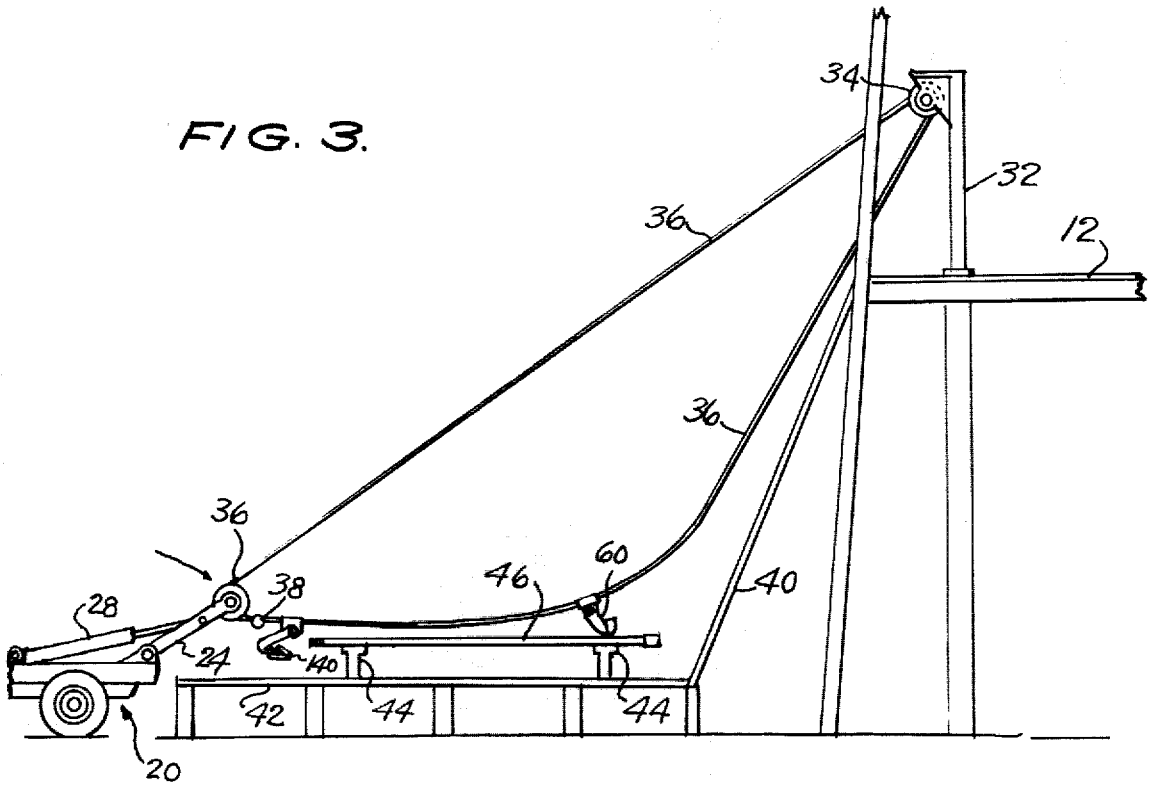
FIG. 3 is a view similar to FIG. 2, but with the pickup machine operated to release a pipe section onto a rack.
Figure 5:
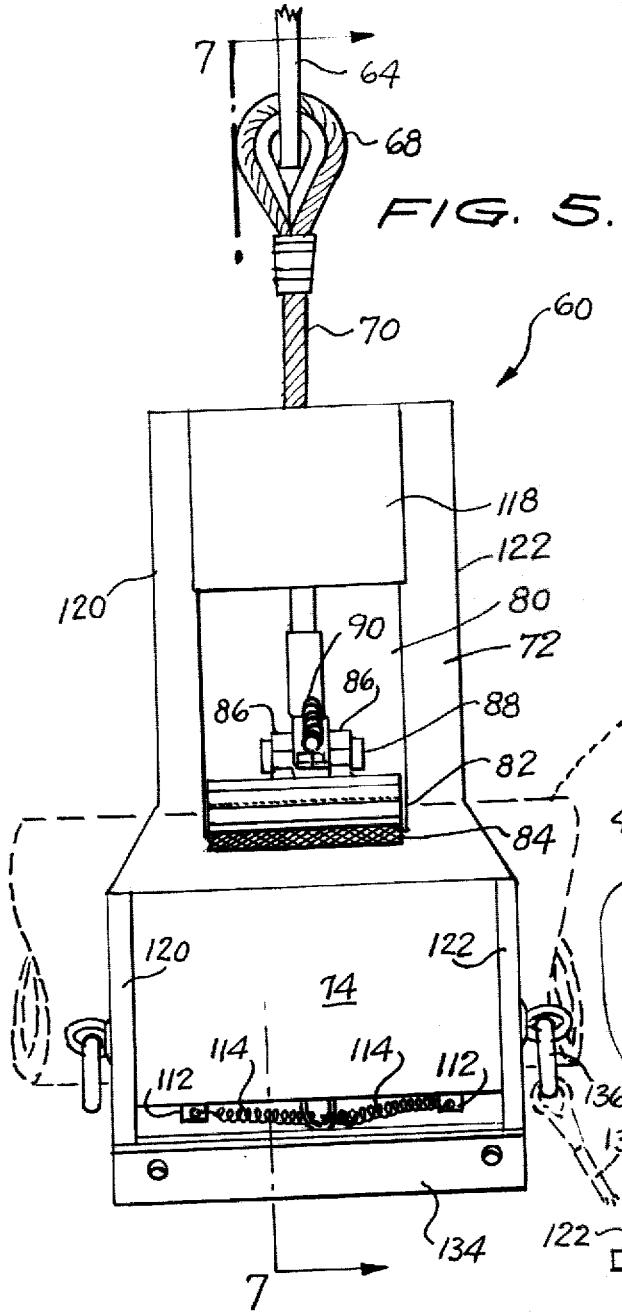
FIG. 5 is an elevational view of the tool of FIG. 4 taken from the left side thereof.
Figure 4:
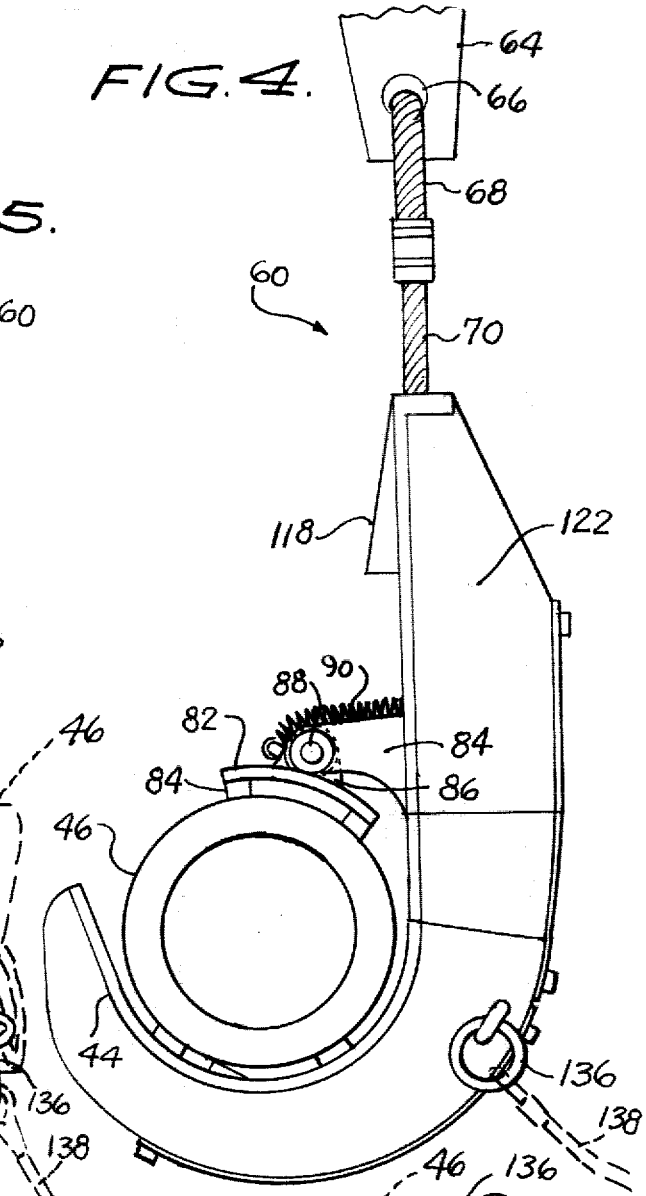
FIG. 4 is an enlarged elevational view of one embodiment of the novel clamping tool taken from line 4—4 of FIG. 2, and looking in the direction of the arrows.
Figure 6:
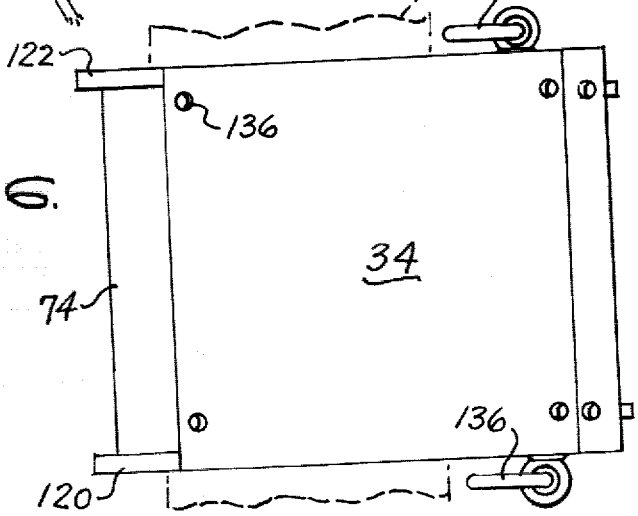
FIG. 6 is a bottom plan view of the tool of FIG. 4.

FIG. 2 illustrates the conventional pickup machine 20 in a condition ready to lower a pipe section toward the rack rails 44, the machine being unchanged from that of FIG. 1, except that a pair of tools 60 and 140, according to the invention, have been substituted for tools 56 and 48, respectively. FIG. 3 depicts the pickup machine with its conveyor 36 relaxed to deposit the pipe on the rails at the instant of, or just after release of clamping tools 60, 140.

Figure 7:
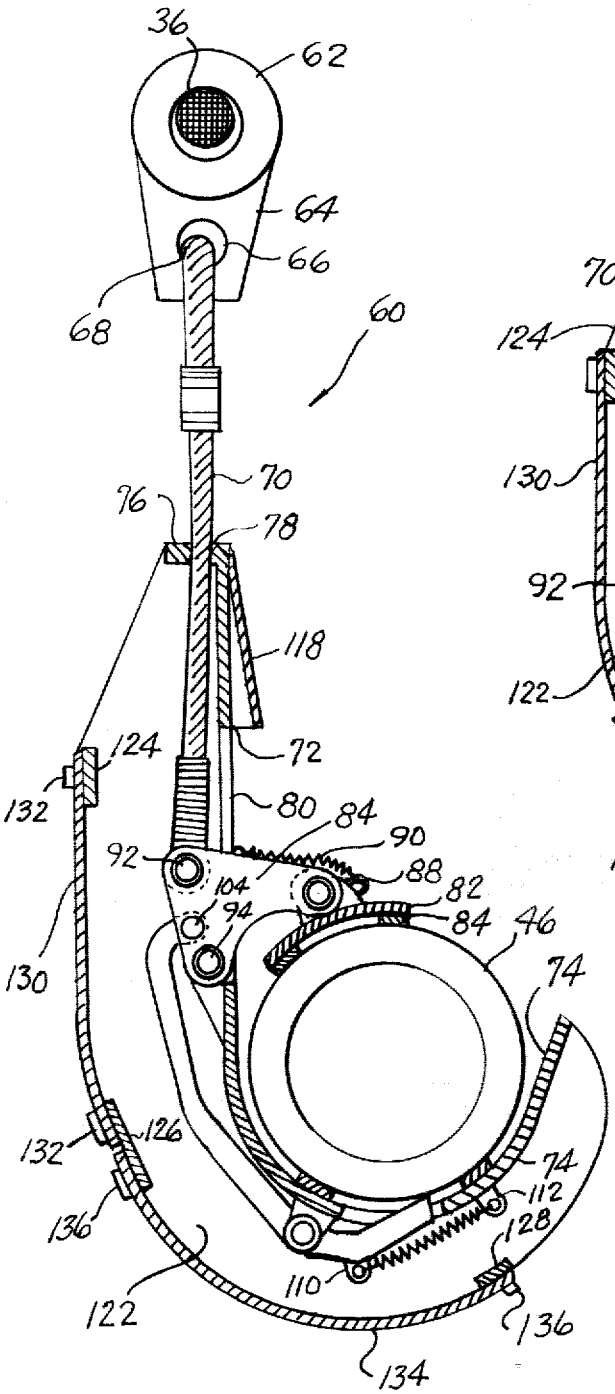
FIG. 7 is a sectional view of the tool of FIG. 4 taken along line 7—7 of FIG. 4, and looking in the direction of the arrows, showing the tool triggered and in clamping condition.
Figure 8:
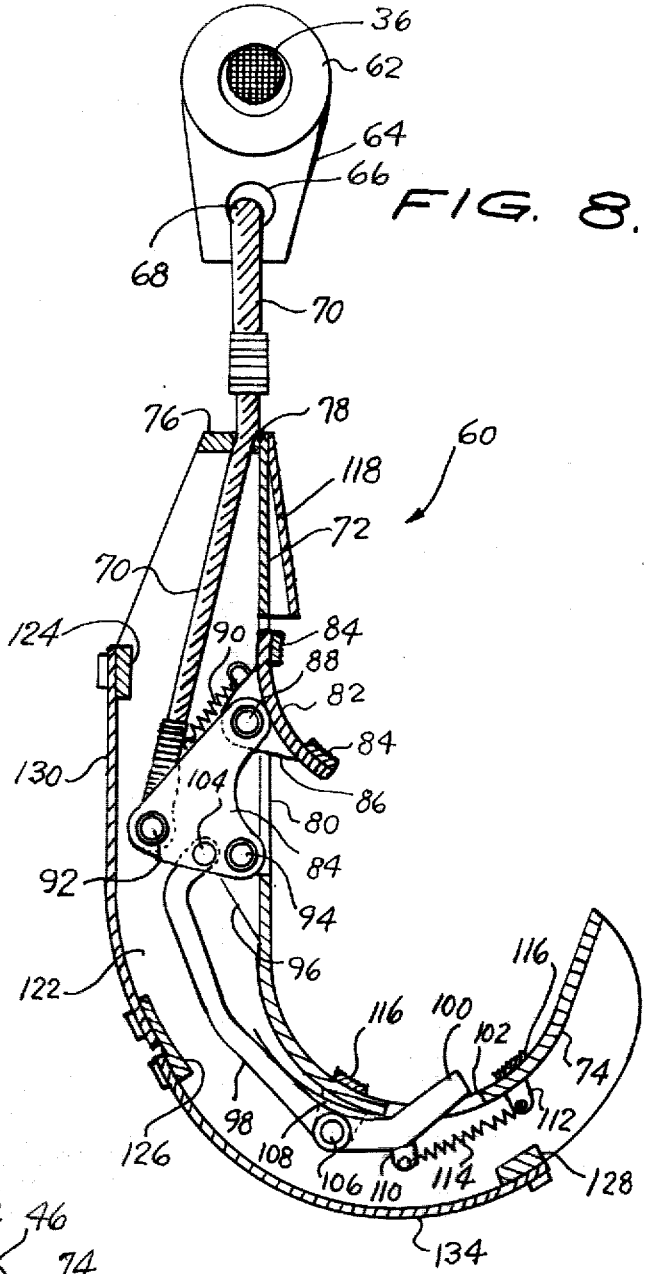
FIG. 8 is a sectional view similar to FIG. 7, but showing the tool in untriggered condition awaiting the reception of a pipe section.
Figure 9:
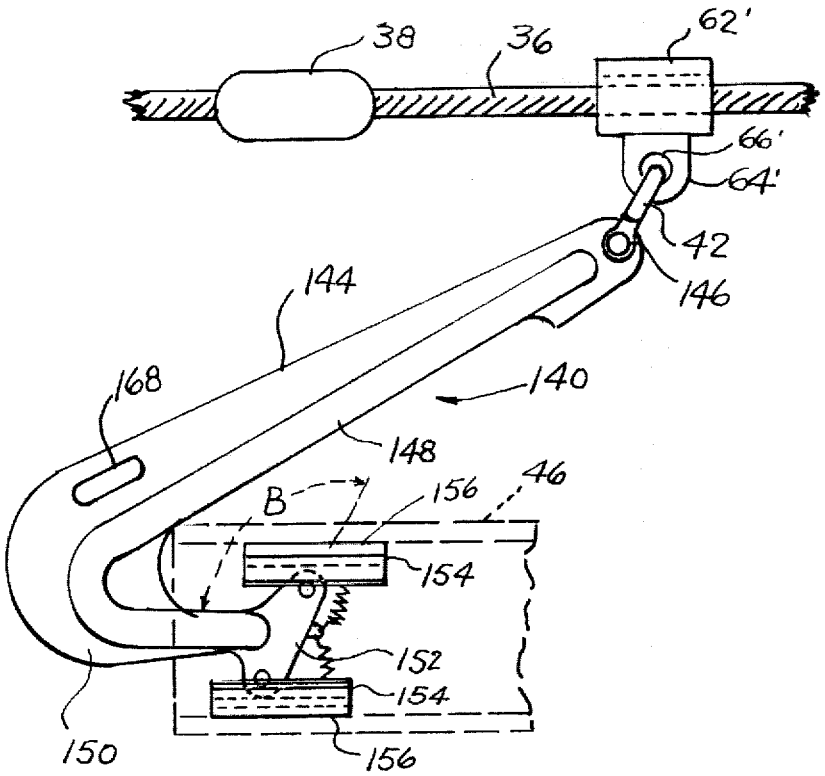
FIG. 9 is an elevational view of a second embodiment of the novel clamping tool according to the invention, shown inserted and clamped within a pipe section depicted in broken lines.
Figure 10:
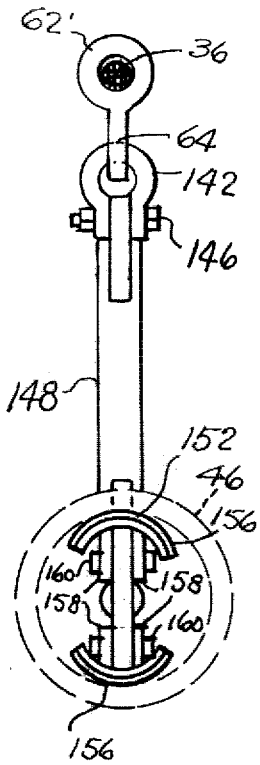
FIG. 10 is an end elevation taken from the right side of FIG. 9.
Figure 11:
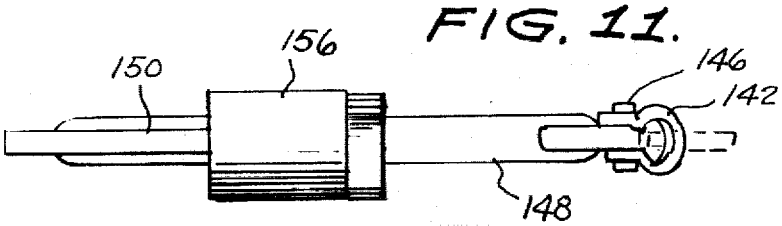
FIG. 11 is a bottom plan view of the tool of FIG. 9.
Figure 12:
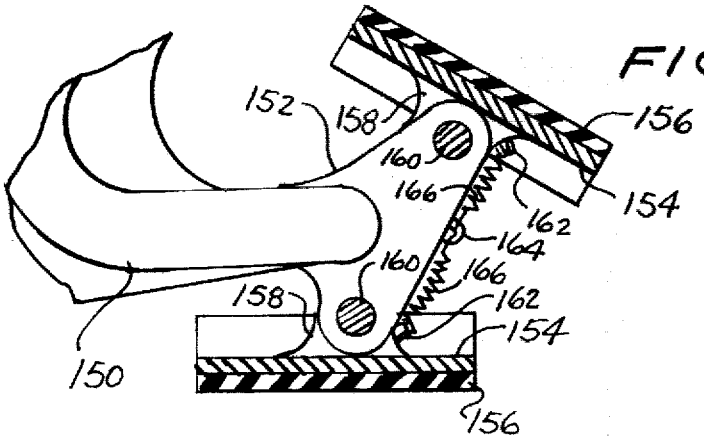
FIG. 12 is an enlarged, fragmentary, sectional view taken longitudinally of the clamping pads of the tool of FIG. 9 prior to insertion into a pipe section.

FIGS. 4 through 8 show the structural details of tool 60. This tool comprises a connector formed of a metal sleeve 62, slideably surrounding the lower reach of conveyor cable 36, and having an integral dependent lug 64 with an opening 66 therethrough for receiving the loop 68 of a flexible support cable 70 to fasten the upper end of the last named cable to the connector. As best seen in FIGS. 7 and 8, the pipe support member 72 is a metal sheet bent into the shape of a letter "J" so that its curved base 74 can seat and cradle one end of a pipe section 46. The upper end 76 of the stem of the J-shaped sheet is bent at right angle to the stem in the direction away from curved base 74 and provided with a guide opening 78 through which the flexible support cable 70 rides. Near the center of the plate stem 72 is a large rectangular opening 80 in which is turnably seated a pad 82 and its operating mechanism, comprising a pair of parallel triangular plates 84 spaced apart by spacers (not shown). The pad 82 is a metal plate having cylindrical curvature conforming to a segment of the outer surface of the pipe and carrying a pair of corrugated rubber or metal strips 83 on its concave surface for frictionally engaging the pipe. The convex surface of the pad has welded thereto, a pair of spaced lugs 86 having aligned openings through which pass a pivot bolt 88, which pivotally secures the pad to the upper corners of the plates 84. A coil spring 90, secured at one end to lugs 86 and at the other end to plates 84, biases the pad to the unclamped position shown in FIG. 8.

A second pivot bolt 92 secures the lower end of support cable 70 to a second corner of the triangular plates 84, whose third and lowermost corners are pivotally secured by third bolt 94 to a lug 96 welded to the stem 72 inwardly and just below the opening 80. The pad operating mechanism is completed by a long, bent trigger arm 98 terminating in a trigger end 100 which protrudes upwardly through a slot 102 in the curved base 74 of the J-shaped cradle support. At the end opposite the trigger, arm 98 is secured between the triangular plates 84 by a pivot pin 104 disposed in line with and between pivots 92 and 94. A fulcrum for arm 98 is provided by pivot bolt 106 passing through aligned openings in a pair of spaced brackets 108. A dependent lug 110 and a pair of lugs 112 are welded to the undersides of arm 98 and curved base 74, respectively. These lugs are connected by a pair of coil springs 114 which bias the trigger 100 upwardly through slot 102. A number of metal strips 116 having corrugated upper surfaces are welded to the curved base 74 to receive and seat the pipe 46. A hood 118 is integrally secured to the upper end of the stem 72, and projects forwardly to at least partially cover pad 82, so as to protect the pad in its unclamped position from being struck by a pipe being dropped into the curved base 74 of the tool.

The pad operating mechanism of the tool 60 is protected by a housing comprising a pair of side walls 120,122 conforming in shape to the J-shaped support member 72 and which are welded, or otherwise secured along their edges to the latter. The opposite edges of the sidewalls are connected by cross braces 124, 126 and 128. A slightly curved rear plate 130, removably secured to braces 124 and 126 by screws 132, covers the rear of the tool. A cylindrically curved plate 134 is removably secured to braces 126 and 128 by screws 136, and normally covers the bottom of the tool. Removal of these plates 130 and 134 permits access to the tool mechanism for maintenance and repair. A pair of rings 136 are swivelly connected to the side walls 120, 122 and ropes 138 tied to these rings enable a workman to swing the tool laterally with respect to conveyor 36 when loading a pipe onto the tool or unloading the pipe onto rails 44.

The clamping tool 60 operates as follows:

FIG. 8 shows the pad and its operating mechanism in unclamped condition with the connector 62 mounting the tool slideably on conveyor 36 to the pickup machine in place of tool 56, FIG. 1. Note that the flexible support cable 70 is bent at guide opening 78, the weight of the tool being insufficient to straighten the cable or overcome springs 90 and 114 which retain the pad and trigger in their illustrated positions. When the upper end of a pipe section being lowered is dropped into the curved base 74 and comes to rest on the friction feet 116, the trigger 100 is depressed causing the trigger arm 98 to turn on fulcrum 106 and exert upward force on pivot 104 tending to rotate triangular plates 84 clockwise about pivot 94. This rotational movement is augmented by the lowering of the tool base 74 due to the weight of the pipe, which straightens cable 70 and lifts pivot 92 of the triangular plates 84 so that the plate completes its clockwise turning to the clamping condition shown in FIG. 7, overcoming the bias of spring 90. The pad 82 turns on its pivot to clampingly engage the top surface of the pipe and holds the pipe locked in this condition, the great weight of the pipe retaining the support cable 70 stretched and pivot 92 slightly counter-clockwise of a vertical line through pivot 94, so that the triangular plate is increasingly urged clockwise by the pipe weight. Thus, once the pipe drops into the tool, there is virtually no chance that it will bounce out and cause injury or damage to persons or equipment. Thus, the tool 60 operates in the same manner as described for conventional tool 56, FIG. 1, except that it automatically clamps and locks onto the pipe.

In order to unclamp the pipe, it is necessary to deliberately lift the heavy pipe slightly from the tool. This may be done for example, in the manner explained for the conventional system of FIG. 1. That is, when the pipe has been moved opposite the rack rails 44 and the pickup machine conveyor relaxed as in FIG. 3 while tool 60 is swung by rope 138 over the rack, the tool will drop below the pipe which is retained at rack level. Thus, the weight of the pipe is removed from the tool allowing spring 90 and springs 114 to return the pad 82 and its operating mechanism to their unclamped condition shown in FIG. 8. This frees the tool entirely from the pipe which has been deposited on the rack.

FIGS. 9 through 12 show the structural details of a second preferred embodiment in which the tool 140 is inserted into a pipe section and automatically clamps against the internal surface of the pipe. As in the first embodiment, a connector sleeve 62' slideably surrounds conveyor cable 36 and has a dependent lug 64' with hole 66' which pivotally holds a metal link 142 of U-shape. The legs of the link are pivotally secured to the upper end of an elongated, rigid support arm 144 by a pivot bolt 146 passing through an opening in the arm. The arm is strengthened and rigidified by longitudinal flange 148. The bottom end of the arm is curved in a hook portion 150 to extend back along the arm for a short distance and at an acute angle thereto. Integrally formed on, or affixed to, the end of hook portion 150 is a short finger 152 extending above and below the end of the hook and at an obtuse angle B thereto. A pair of pads 154 having rubber or other friction, external liners 156, and cylindrically shaped to fit the internal surface of pipe 46, are pivotally secured to the ends of finger 152. For this purpose, each pad is provided with a pair of spaced lugs 158 which straddle the finger 152 and have aligned holes through which is passed a pivot bolt 160. One of each pair of lugs 158 is provided with an outwardly protruding, holed protrusion 162, which is connected to a similar protrusion 164 on finger 152 by a coil spring 166. The pair of springs 166 biases the outer ends of pads 154 toward each other so that they and the hook portion 150 of the tool may be easily inserted into a pipe section 46. The length of finger 152, plus the thickness of the pair of lined pads 154, is made slightly larger than the internal diameter of the pipe to be clamped. A hand hole 168 is formed in arm 144 for grasping to swing and manipulate the tool.

Operation of tool 140 is as follows:

When a workman swings the lower end of an uncoupled, hanging pipe section from the well head 14 toward the conveyor 36, another worker grasping arm 144 at hand hold 168 swings the pads 154 and hook 150 into the open end of the pipe. The pads 154 contacting the internal pipe surface tend to turn parallel to each other against the bias of springs 166. As the upper end of the pipe 46 is being lowered and the lower end is being carried by the tool and conveyor 36 in the direction of arrow A, FIG. 1, the weight of the pipe section turns arm 144 counter-clockwise about pivot 146 as viewed in FIG. 9, carrying the finger 152 in the same counter-clockwise direction and toward the perpendicular represented by the pipe diameter. Since the finger and pads together are greater in length than the internal diameter of the pipe, the pads are pressed into tighter and tighter contact with the inner surface of the pipe as more and more weight of the pipe is exerted on the tool during handling and movement of the pipe section, so that there is virtually no danger that the pipe will be released and fall from the tool. When the pipe is swung over the rack and lowered into contact therewith, the pipe is lifted with respect to the tool relieving the tool of the pipe weight. This causes arm 144 and finger 152 to turn clockwise about pivot 146, releasing the clamping pressure of the pad on the internal pipe surface. The tool may then be grasped at 168 and easily pulled out of the pipe.

It should be apparent from the above descriptions of the modes of operation that a pair of tools 60 or a pair of tools 140 may be utilized on conveyor 36 rather than one of each. Also, either tool or both may be used in picking up, laying down, or otherwise handling, well casings, or other tubular parts, as well as drill pipe sections.

Although certain specific embodiments of the invention have been shown and described, it is obvious that many modifications thereof are possible. The invention, therefore, is not intended to be restricted to the exact showing of the drawings and description thereof, but is considered to include reasonable and obvious equivalents.

What is claimed is:

1. A clamping tool for use in lifting, lowering and moving drill pipes, casings, tubes and the like, comprising a rigid member to be clamped to a pipe for supporting the same, pad means secured to said member by a first pivot means for turning movements to clampingly engage or disengage against a surface of a pipe, and connecting means secured to said member by a second pivot means for connecting the tool to a handling device such as a pickup and lay down machine, said rigid member, connecting means and first and second pivot means being so shaped and arranged with respect to one another that the weight of a pipe exerted on the tool will cause the pad means automatically to turn and lockingly clamp the pipe, and lifting the pipe slightly to remove its weight from the tool will cause said pad means automatically to release its clamping engagement with the pipe, said rigid member being J-shaped in cross section so as to receive a pipe end in its curved base, said pad means being secured by said first pivot means to one corner of a triangular plate having a second corner secured to the stem of the J-shaped member by a third pivot means, said connecting means being secured by said second pivot means to the third corner of said triangular plate.

2. A clamping tool, as set forth in claim 1, wherein is provided a trigger at one end of an arm whose other end is secured by a fourth pivot means to said triangular plate, said arm having a fulcrum near the trigger and pivoted to the curved base of the J-shaped member.

3. A clamping tool, as set forth in claim 2, wherein a first spring means is connected between said pad means and said triangular plate biasing said pad means toward an unclamped position, and a second spring means is connected between said trigger and said rigid member biasing the trigger upwardly into the curve of the base of said J-shaped rigid member.

4. A clamping tool, as set forth in claim 3, wherein said connecting means comprises a sleeve member for attachment to pipe handling apparatus and a flexible cable of relatively short length having one end secured to the sleeve member and the other end secured to said second pivot means.

5. A clamping tool, as set forth in claim 4, wherein said flexible cable is slideable through a guide means at the upper end of the stem of the J-shaped member and its connection to said second pivot means is slightly displaced laterally from a vertical line passing through the guide means in the clamped positions of said pad means and triangular plate, the said connection of the flexible cable to the second pivot means being displaced laterally a greater distance from said vertical line in the unclamped positions of said pad means and said triangular plate.

6. A clamping tool, as set forth in claim 5, wherein said fourth pivot means connecting the trigger arm to the triangular plate is located substantially between and in a line connecting the said second and third pivot means.

7. A clamping tool, as set forth in claim 6, wherein said J-shaped rigid member forms one wall of a housing encasing said triangular plate, said trigger arm and a portion of said flexible cable, a first slot being formed in the curved base of the rigid member through which the trigger protrudes from said housing, and a second slot being formed in the stem of the J-shaped member through which said triangular plate and pad means may turn to extend over a pipe into clamping position.

8. A clamping tool, according to claim 7, wherein removable plates form parts of said housing whereby access may be had to the interior of the housing for maintenance of those parts of the tool housed therein.

9. A clamping tool for use in lifting, lowering and moving drill pipes, casings, tubes and the like, comprising a rigid member to be clamped to a pipe for supporting the same, pad means secured to said member by a first pivot means for turning movements to clampingly engage or disengage against a surface of a pipe, and connecting means secured to said member by a second pivot means for connecting the tool to a handling device such as a pickup and lay down machine, said rigid member, connecting means and first and second pivot means being so shaped and arranged with respect to one another that the weight of a pipe exerted on the tool will cause the pad means automatically to turn and lockingly clamp the pipe, and lifting the pipe slightly to remove its weight from the tool will cause said pad means automatically to release its clamping engagement with the pipe, said rigid member comprising a long arm with a hook portion at one end curved inwardly to extend a short distance along the arm and at an acute angle thereto, said hook portion terminating in a finger attached thereto at an obtuse angle and extending both above and below the hook portion, said pad means being secured by first pivot means to an end of said finger, said connecting means being secured by said second pivot means to the free end of said long arm, said hooked portion and pad means being adapted to be inserted into the open end of a pipe, whereby the weight of the pipe will swing the arm, hooked portion and finger so as to turn the pad means and exert clamping pressure on the internal surface of the pipe.

10. A clamping tool, as set forth in claim 9, wherein said pad means comprises a pair of pads and said first pivot means comprises a pair of pivots located at the ends of said finger.

11. A clamping tool, as set forth in claim 10, wherein the distance between said pair of pivots is at least as large as the internal diameter of the pipe to be clamped, whereby the weight of the pipe exerted on said connecting means operates to turn said arm, said finger and said pads to exert great clamping pressure on the interior surface of the pipe.

12. A clamping tool, according to claim 11, wherein a pair of springs are connected between the center portion of said finger and said pair of pads biasing the outer ends of the pads toward one another to enable easier insertion into a pipe.

13. A clamping tool, according to claim 12, wherein said connecting means comprises a sleeve member for attachment to pipe handling apparatus, said sleeve being pivoted to a link which is connected to said second pivot means at the end of said long arm opposite said hook portion.

14. In a system for picking up and laying down drill pipe and the like, the combination of a pickup and lay down machine having an endless conveyor forming a loop with upper and lower parallel courses adapted to move the pipe and a pair of clamping tools for attachment to opposite ends of the pipe section to be moved, said tools each comprising a rigid pipe supporting member, pad means secured to said member by a first pivot means for turning movements to clampingly engage or disengage a pipe surface, and connecting means attached to said conveyor and secured to said rigid member by a second pivot means, said rigid member, connecting means, and first and second pivot means being so shaped and arranged with respect to one another that the weight of a pipe exercised on the tool will cause the pad means automatically to turn and lockingly clamp a pipe surface, and lifting the pipe slightly to remove its weight from the tool will cause said pad means to automatically release its clamping engagement against the pipe surface, said pad means of one of said tools engaging and clamping against the outside surface of a pipe and pad means of the other of said tools engaging and clamping against the inside surface of a pipe, said one tool comprising a J-shaped rigid member, a triangular plate, a trigger and trigger arm and spring biasing means, said first pivot means being disposed at one corner of said triangular plate, a second corner of the triangular plate being secured to the stem of the J-shaped member by third pivot means, said second pivot means being secured to the third corner of the triangular plate, said trigger arm being secured by a fourth pivot means to the triangular plate and having a fulcrum near the trigger pivoted to the curved base of the J-shaped member, said spring biasing means including a spring connected between the triangular plate and the rigid member biasing the plate and pad means toward an unclamped position, and a second spring connected between the trigger and rigid member biasing the trigger upwardly into the curve of the base of the J-shaped member.

15. The combination, as set forth in claim 14, wherein said other tool comprises a rigid member having a long arm with a hook portion at one end curved to extend along and at an acute angle to the arm and terminating in a finger extending above and below the hook portion, said pad means including a pair of pads secured by said first pivot means to the upper and lower ends of the finger, said connecting means being secured by said second pivot means to the end of said long arm opposite the hook portion, and a pair of springs connected between the center of said finger and said pair of pads biasing the outer ends of the pads toward one another, the length of said finger and thickness of said pads together being slightly greater than the internal diameter of the pipe to be clamped, whereby upon insertion of the hook portion and pad means into the open end of a pipe, the weight of the pipe will turn the finger and pads so as to exert clamping pressure against the inside surface of the pipe.

16. A clamping tool for use in lifting, lowering and moving elongated cylindrical objects such as pipes, comprising: a J-shaped rigid member adapted to be clamped to a pipe or the like for supporting the same;

means pivotally attached to said rigid member for clampingly engaging a surface of said pipe; and means actuated by the weight of said pipe comprising trigger means located in the curved base portion of said J-shaped member and further comprising means operatively linking said trigger means to said means for clampingly engaging for causing said means for clampingly engaging to clampingly engage the upper, outer surface of said pipe when the lower, outer surface of said pipe engages said trigger means.

17. A clamping tool for use in lifting, lowering and moving elongated cylindrical objects such as pipes, comprising:

a rigid member adapted to be clamped to a pipe or the like for supporting the same comprising an arm having a hook at the end thereof adapted to enter the interior of said pipe, and means actuated by the weight of said pipe comprising a finger affixed across the end of said hook member with a means for clampingly engaging a surface of said pipe comprising a pad pivotably mounted at each end of said finger and spring biased toward each other, the weight of said pipe causing the pads to engage oppose inner surfaces of said pipe.

18. In a system for picking up and laying down drill pipe and the like, the combination of a pickup and lay down machine having an endless conveyor forming a loop with upper and lower parallel courses adapted to move the pipe and a pair of clamping tools for attachment to opposite ends of the pipe section to be moved, each tool comprising:

(a) a rigid member adapted to be clamped to a pipe or the like for supporting the same;

(b) pad means pivotably attached to said rigid member for clampingly engaging a surface of said pipe; and (c) means actuated by the weight of said pipe for automatically engaging said pad means with said pipe surface.

19. A tool for lifting, lowering or moving an object, comprising:

a rigid member adapted to be clamped to said object, and for supporting said object during lifting, lowering or moving;

means attached to said rigid member for clamping said object against said rigid member;

trigger means for moving said means for clamping from a first position where said object is not clamped to said rigid member to a second position where said object is clamped to said rigid member, in response to contact of said object with said trigger means.

* * * * *